420-492 SR
1/28/86 XR 4,566,915

United States Patent [19]
Ikushima et al.

[11] Patent Number: 4,566,915
[45] Date of Patent: Jan. 28, 1986

[54] PROCESS FOR PRODUCING AN AGE-HARDENING COPPER TITANIUM ALLOY STRIP

[75] Inventors: Kazuo Ikushima; Yoshio Itoh; Toshiaki Ishihara, all of Nagoya, Japan

[73] Assignee: NGK Insulators, Ltd., Japan

[21] Appl. No.: 670,930

[22] Filed: Nov. 13, 1984

[30] Foreign Application Priority Data

Nov. 22, 1983 [JP] Japan ..... 58-220139

[51] Int. Cl.[4] ..... C22F 1/08
[52] U.S. Cl. ..... 148/11.5 C; 148/12.7 C; 420/492
[58] Field of Search ..... 148/11.5 C, 12.7 C, 148/13.2; 420/492, 490

[56] References Cited

U.S. PATENT DOCUMENTS

| | | | |
|---|---|---|---|
| 2,943,960 | 7/1960 | Saarivirta | 148/411 |
| 4,073,667 | 2/1978 | Caron et al. | 148/12.7 C |
| 4,425,168 | 1/1984 | Goldstein et al. | 148/2 |

OTHER PUBLICATIONS

Kato et al., "Hardening by Spinodal Modulated Structure", Acta Metallurgica, vol. 28, 1980, pp. 285–290.

*Primary Examiner*—Peter K. Skiff
*Attorney, Agent, or Firm*—Parkhurst & Oliff

[57] ABSTRACT

A process for producing an age-hardened copper titanium alloy strip includes preparing a copper titanium alloy melt, casting it, hot-working the cast alloy, cold-working the hot-worked alloy as required, annealing the hot-worked or cold-worked alloy, solution heat-treating the annealed alloy, and then the solution heat-treated alloy is age-hardened. The alloy is annealed at a temperature of 500° C. to 700° C. for one to 20 hours. Its solution heat treatment is terminated before or approximately as soon as a precipitated secondary phase has formed a complete solid solution in a master phase, so that the master phase may have an average crystal grain size not exceeding 25 microns. It is preferably terminated within three minutes. The alloy has a titanium content of 2 to 6% by weight.

12 Claims, 1 Drawing Figure

PROCESS FOR PRODUCING AN AGE-HARDENING COPPER TITANIUM ALLOY STRIP

BACKGROUND OF THE INVENTION

1. Field of the Invention

This invention relates to a process for producing an age-hardened copper titanium alloy strip. More particularly, it relates to the production of an age-hardened copper titanium alloy strip composed of a fine and uniform crystal structure and having excellent and uniform physical properties.

2. Description of the Prior Art

An age-hardened copper titanium alloy strip has excellent mechanical strength and electrical conductivity and is, therefore, used often to make electrically conductive springs of the thin plate type. Such spring sheets are usually produced by a process which includes preparing a copper titanium melt, casting it, hot-working the cast copper titanium, subjecting the hot-worked copper titanium to alternate annealing and cold working to a strip having a final shape. Then, the obtained strip is subjected to solution heat-treatment, and cold-worked again as required, and finally age-hardened.

The process employs, generally, a temperature of 800° C. to 900° C. for the recrystallization annealing or softening, or solution heat treatment of the alloy. This temperature is higher than a temperature of 720° C. to 800° C. which is usually employed for the recrystallization softening of an age-hardening copper beryllium alloy which is also used to make electrically conductive springs, and which is disclosed, for example, in U.S. Pat. No. 4,425,168 issued to Goldstein et al. on Jan. 10, 1984. The use of such a high temperature greatly promotes the growth of crystal grains, and the final product has an average crystal grain size of 40 microns or more, and sometimes even as large as 100 microns.

The coarsening of crystal grains adversely affects the formability, spring life, elongation, yield strength and other properties of the alloy and is a major cause for a wide range of variation in its properties. These problems associated with copper titanium alloy strips have hitherto been very difficult to solve, and no effective solution has been found.

SUMMARY OF THE INVENTION

Under these circumstances, it is a primary object of this invention to provide a process for producing an age-hardened copper titanium alloy strip which has excellent formability, fatigue strength, elongation, yield strength and other properties.

It is another object of this invention to provide a process which makes it possible to prevent the coarsening of crystal grains during annealing and solution heat treatment and thereby produce an age-hardened copper titanium alloy composed of a fine and uniform crystal structure and having drastically improved physical properties.

This object is attained by a process comprising annealing an appropriately worked copper titanium alloy at a temperature which is lower than a solid solution boundary temperature and a recrystallization temperature, so that a fine secondary phase may be uniformly precipitated in a master or matrix phase, and after cold rolling the alloy, if so required, subjecting it to solution heat treatment such that the treatment is terminated before or approximately as soon as the secondary phase has formed a full solid solution in the master or matrix phase. The thus obtained alloy is then age-hardened.

DETAILED DESCRIPTION OF THE INVENTION

Figure 1:
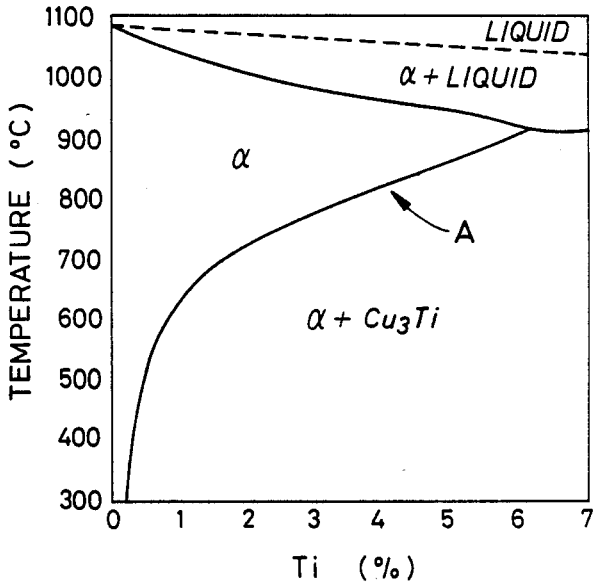
FIG. 1 is a binary phase diagram for a copper titanium alloy.

The term "master or matrix phase" as herein used means the $\alpha$-phase in the binary phase diagram for a copper titanium alloy, and the term "secondary phase" means the precipitate of an intermetallic compound expressed as $Cu_3Ti$. The "solid solution boundary temperature" is a temperature defining the boundary between the $\alpha+Cu_3Ti$ phase and the $\alpha$-phase, which is shown by the curve A in FIG. 1.

The strip of this invention comprises an alloy consisting mainly of copper and containing 2 to 6% by weight of titanium. The alloy preferably contains 3 to 5% by weight of titanium. If its titanium content is less than 2% by weight, no appreciable effect of age-hardening can be expected, and the addition of more than 6% by weight of titanium does not provide a correspondingly improved effect of age-hardening. This invention is also applicable to other copper alloys containing other elements, such as Fe, Zr, Cr, B and Si, in addition to 2 to 6% by weight of titanium. Such other element(s) is (are) generally contained up to 2.0% by weight in a total amount.

A copper titanium melt of the composition as hereinabove set forth is prepared and cast to form an ingot by known methods. The ingot is hot-forged or hot-rolled, and the hot-worked product is cold-rolled or cold-worked as required.

According to this invention, the hot-worked or cold-worked material is subjected to an intermediate annealing at a temperature which is lower than the solid solution boundary temperature and the recrystallization temperature. Stated differently, this intermediate annealing is effected at a temperature lower than ordinary annealing in order to achieve the fine and uniform distribution and precipitation of the secondary phase ($Cu_3Ti$) in the master ($\alpha$) phase.

The use of intermediate annealing at a temperature which is lower than both of the solid solution boundary and recrystallization temperature is important for the precipitation of a fine and uniformly distributed secondary phase in the master phase. If the annealing temperature exceeds the solid solution boundary temperature, no secondary phase is precipitated in the master phase. If it is lower than the solid solution boundary temperature, but exceeds the recrystallization temperature, it is impossible to obtain a fine, uniformly distributed secondary phase, since the growth of crystal grains starts in the master phase and reduces the amount of the precipitate and results in a coarse secondary phase.

The fine and uniform secondary phase formed by the intermediate annealing in the master phase contributes to avoiding the coarsening of crystal grains in the master phase during the final solution heat treatment of the alloy. If an alloy having a secondary phase which is not finely and uniformly distributed in the master phase is subjected to solution heat treatment, the crystal grains in the master phase lose uniformity in size and become coarse. The secondary phase finely and uniformly distributed in the master phase usually has a grain size not exceeding about five microns.

The specific temperature and time for intermediate annealing of the copper titanium alloy depend on various factors, such as the titanium content of the alloy and the mode of working employed, and are therefore difficult to set forth in a definite fashion. It is, however, generally suitable to hold the alloy at a temperature of 500° C. to 700° C. for a period of time of one to 20 hours.

The annealed alloy is subjected to solution heat treatment after it has been cold-worked, or without being cold-worked. The fine and uniform secondary phase in the master phase contributes to avoiding effectively the coarsening of crystal grains in the master phase during the heating of the alloy for its solution heat treatment, and to quick formation of a uniform solid solution in the master phase at a solution heat treatment temperature which is higher than the solid solution boundary and recrystallization temperatures. It is sufficient to hold the alloy at that temperature for a very short period of time as compared with the solution heat treatment for the conventional age-hardened copper titanium alloy. The secondary phase forms a desired solid solution in the master phase without causing any coarsening of crystal grains. According to this invention, therefore, it is possible to easily produce a copper titanium alloy strip having a fine crystalline metal structure.

The solution heat treatment is preformed for a period of time ending immediately after or which terminates with water cooling before or approximately as soon as a precipitated secondary phase has dissolved in a master phase forms a solid solution with the master phase. So long as the fine and uniform precipitate of the secondary phase formed by the intermediate annealing exists in the master phase, no appreiciable coarsening of crystal grains takes place during the solution heat treatment. The crystal grains in the master phase, however, shows a heavy coarsening behavior and fail to form a fine crystal structure if the alloy is left at a high solution heat treatment temperature after the secondary phase has formed a complete solid solution in the master phase.

The time for solution heat treatment depends on various factors, such as the chemical composition and thickness of the alloy strip, the size of the secondary phase and whether the strip has been cold-worked prior to its solution heat treatment. This treatment time is generally determined so that the crystal grains in the master phase do not grow to an average grain size exceeding 25 microns, preferably 15 microns. It is difficult to set forth the time in a definite fashion. If the strip has a small thickness, a period of time up to three minutes is sufficient, and if it has a large thickness, it may be necessary to continue the treatment for a period of from 30 minutes to one hour, depending on the strip thickness.

The solution heat-treated alloy having a fine crystal structure, which is obtained according to the invention, is age-hardened by a customary method after it has been cold-rolled or otherwise worked, as required.

As is obvious from the foregoing description, the process of this invention is characterized by annealing an appropriately hot-worked or cold-worked copper titanium alloy at a temperature which is lower than the solid solution boundary and recrystallization temperatures, and subjecting the annealed alloy to solution heat treatment for a period of time ending before the coarsening of crystal grains starts to take place. Thus, the process of the invention enables the advantageous production of an age-hardened copper titanium alloy strip having a fine and uniform structure. The fine crystal structure obtained according to this invention gives the alloy strip greatly improved formability, spring life, elongation and yield strength. Further, the fine crystal structure assures an extremely small variation in these properties. That is, the properties in the rolling direction do not show any substantial difference from the properties in a direction perpendicular to the rolling direction. Thus, this invention produces an age-hardened copper titanium alloy strip of very high reliability.

The invention will now be described more specifically with reference to several examples which are merely illustrative of this invention and not intended to limit its scope.

EXAMPLE 1

A copper titanium alloy containing 4.0% by weight of titanium, the balance being copper and inevitable impurities, was melted, cast and hot-forged and hot-rolled to a thickness of 1.2 mm by a customary process. It was, then, held at a temperature of 800° C. for 10 minutes, water-cooled and cold-rolled to a thickness of 0.5 mm. Samples Nos. 1 to 8 of the cold-rolled material were subjected to intermediate annealing and solution heat treatment under different conditions as will hereinafter be set forth.

(a) Sample No. 1 (this invention):

The cold-rolled material was held at a temperature of 650° C. for eight hours (intermediate annealing) to obtain a secondary phase having a fine, uniformly precipitated structure. Then, it was held at a temperature of 830° C. for five seconds and water-cooled (final solution heat treatment). There was obtained a product composed of a uniform structure having a secondary phase forming a complete solid solution in a master phase having an average crystal grain size of 10 microns.

(b) Sample No. 2 (this invention):

The cold-rolled material was held at a temperature of 650° C. for eight hours (intermediate annealing). It was, then, heated at a temperature of 830° C. for three seconds and water-cooled (final solution heat treatment). Thus, there was obtained a product composed of a metal structure having a secondary phase uniformly distributed in a small quantity in a master phase having an average crystal grain size of six microns.

(c) Sample No. 3 (comparative):

The cold-rolled material was intermediate annealed at a temperature of 650° C. for eight hours, held at a temperature of 830° C. for three minutes and water-cooled. The master phase in the product had an average crystal grain size of 40 microns.

(d) Sample No. 4 (conventional):

The cold-rolled material was directly subjected to solution heat treatment at a temperature of 830° C. without being annealed at 650° C. It was necessary to hold the material at 830° C. for three minutes before a secondary phase has formed a full and uniform solid solution in a master phase. When the material was water-cooled, the master phase had an average crystal grain size of 40 microns.

(e) Sample No. 5 (comparative):

The cold-rolled material was held at a temperature of 830° C. for five seconds without being intermediate annealed at 650° C., and water-cooled. There was obtained a product composed of a nonuniform metal structure having a nonuniform secondary phase remaining in a master phase having a crystal grain size of 10 to 40 microns.

Samples Nos. 1 to 5 were cold-rolled to a thickness of 0.3 mm to provide H-condition materials. The H materials were age-hardened at a temperature of 400° C. for two hours to provide HT-condition materials.

(f) Sample No. 6 (this invention):

The cold-rolled material was annealed at a temperature of 600° C. for 10 hours and cold-rolled to a thickness of 0.25 mm. It was then solution heat-treated at a temperature of 830° C. for three seconds, and water-cooled. There was obtained a product composed of a uniform metallic crystal structure having a secondary phase forming a solid solution in a master phase having an average crystal grain size of eight microns.

(g) Sample No. 7 (conventional):

The cold-rolled material was annealed at a temperature of 800° C. for five minutes, water-cooled and cold-rolled to a thickness of 0.25 mm. The strip was then solution heat-treated at a temperature of 830° C. It was necessary to hold the material at 830° C. for two minutes before a secondary phase formed a full and uniform solid solution. The solution heat-treated strip was water-cooled, and had an average crystal grain size of 45 microns.

(h) Sample No. 8 (comparative):

The cold-rolled material was annealed at a temperature of 800° C. for five minutes, water-cooled and cold-rolled to a thickness of 0.25 mm. The strip was then solution heat-treated at a temperature of 830° C. for three seconds and water-cooled. There was obtained a product composed of a nonuniform structure having a nonuniform secondary phase remaining in a master phase having a crystal grain size of 10 to 30 microns.

Samples Nos. 6 to 8 were cold-rolled to a thickness of 0.15 mm to provide H-condition materials. The H-condition materials were age-hardened at a temperature of 400° C. for two hours to provide HT-condition materials.

The H-condition and HT-condition materials obtained from Samples Nos. 1 to 8 were tested for mechanical properties. The results are shown in TABLES 1 and 2. As is obvious from TABLES 1 and 2, Samples Nos. 1 and 6 of the strip according to this invention, which were composed of a structure having a small average crystal grain size (10 and 8 microns, respectively), were superior in all of tensile strength, yield strength, elongation and 90° bend formability to Samples Nos. 4 and 7 of the strip produced by the conventional process, which were composed of a structure having a large average crystal grain size (40 and 45 microns, respectively). Moreover, the strip obtained according to this invention showed only a very small difference between its properties in the rolling direction (0°) and those in a direction perpendicular thereto (90°), as opposed to the strip produced by the conventional process (Samples Nos. 4 and 7). It is to be noted that Samples Nos. 1 and 6 and Samples Nos. 4 and 7 were substantially equal in hardness.

As is also obvious from TABLES 1 and 2, Sample No. 2 according to this invention, which was composed of a structure containing a secondary phase distributed uniformly in a small quantity and having an average crystal grain size of six microns, was superior to Samples Nos. 1 and 6 and Samples Nos. 4 and 7 in elongation and formability, though inferior in hardness and strength, and showed only a very small difference between its properties in the rolling direction and those in the direction perpendicular thereto.

Sample No. 3, which had been obtained by annealing at 650° C. for two hours, solution heat-treating at 830° C. for three minutes and water cooling, had its crystal grains coarsened by the prolonged solution heat treatment, and its properties were substantially equal to those of Samples Nos. 2 and 7. Samples Nos. 5 and 8, which had been solution heat-treated at 830° C. for short periods of time without being subjected to the intermediate annealing of this invention, could not obtain any satisfactory effect of solution heat treatment. Therefore, they were low in hardness and strength, and their properties showed a wide range of variation depending on the direction in which they were tested.

TABLE 1

| Sample No. | Classification | Hardness (HV) | Tensile Strength (kgf/mm²) | | 0.2% Yield Strength (kgf/mm²) | | Elongation (%) | | 90° Bend Formability (bend radius/thickness) | |
|---|---|---|---|---|---|---|---|---|---|---|
| | | | 0° | 90° | 0° | 90° | 0° | 90° | 0° | 90° |
| 1 | H | 246 | 81.1 | 80.0 | — | — | 2.5 | 2.7 | 1 | 1 |
| 1 | HT | 337 | 106.8 | 107.3 | 97.4 | 95.8 | 8.9 | 9.3 | 0.5 | 0.5 |
| 2 | H | 253 | 84.4 | 84.1 | — | — | 2.8 | 2.8 | 1 | 1 |
| 2 | HT | 319 | 99.8 | 100.1 | 95.6 | 95.3 | 12.3 | 12.7 | 0.25 | 0.25 |
| 3 | HT | 344 | 106.1 | 100.3 | — | — | 2.3 | 3.9 | 2 | 3 |
| 4 | H | 248 | 76.7 | 71.9 | — | — | 1.6 | 2.1 | 3 | 5 |
| 4 | HT | 340 | 103.5 | 97.2 | 94.3 | 85.9 | 2.3 | 3.8 | 2 | 3 |
| 5 | HT | 298 | 89.3 | 84.1 | — | — | 3.5 | 5.9 | — | — |

TABLE 2

| Sample No. | Classification | Hardness (HV) | Tensile Strength (kgf/mm²) | | 0.2% Yield Strength (kgf/mm²) | | Elongation (%) | | 90° Bend Formability (bend radius/thickness) | |
|---|---|---|---|---|---|---|---|---|---|---|
| | | | 0° | 90° | 0° | 90° | 0° | 90° | 0° | 90° |
| 6 | H | 249 | 85.1 | 85.0 | — | — | 2.7 | 2.7 | 1 | 1 |
| 6 | HT | 338 | 110.5 | 110.1 | 98.4 | 98.0 | 10.0 | 10.2 | 0.5 | 0.5 |
| 7 | H | 246 | 74.3 | 70.5 | — | — | 1.0 | 1.9 | 3 | 5 |
| 7 | HT | 341 | 102.1 | 97.4 | 90.1 | 83.9 | 2.0 | 3.1 | 2 | 4 |
| 8 | HT | 293 | 89.0 | 87.5 | — | — | 3.7 | 5.1 | — | — |

EXAMPLE 2

Three copper titanium alloys of the age-hardened type containing 2.5, 4.0 and 5.5%, respectively, by weight of titanium, the balance being copper and inevitable impurities, were melted, cast and hot-forged and hot-rolled by a customary process to form three strips each having a thickness of 1.2 mm. Each strip was heat-treated at a temperature of 800° C. for 10 minutes, water-cooled and cold-rolled to a thickness of 0.5 mm. The cold-rolled strips were annealed at temperatures increasing by increments of 50° C. from 450° C. to 750° C. for periods of time of 30 minutes and one, two, four, eight, 16 and 24 hours. Each strip was examined for its annealed structure.

All of the strips failed to form a structure having a fine, uniformly precipitated secondary phase even if they were annealed at a temperature of 450° C. for 24 hours. All of the strips were found to form a structure having a fine, uniformly precipitated secondary phase if they were annealed at 500° C. for 16 hours or longer, at 550° C. for eight hours or longer, at 600° C. for four hours or longer, or at 650° C. for two hours or longer. They were also found to form a fine, but slightly less uniform precipitate if they were annealed at a temperature of 500° C. or above for at least one hour. The strips containing 4.0 or 5.5% by weight of titanium formed a fine, uniformly precipitated secondary phase if they were annealed at 700° C. for at least one hour.

The growth of crystal grains and a reduction in the amount of the secondary phase precipitate were observed in the materials containing 2.5% by weight of titanium and annealed at 700° C. and 750° C. and the materials containing 4.0 and 5.5% by weight of titanium and annealed at 750° C. if they were held at those temperatures for over 30 minutes.

The annealed materials were solution heat-treated for a period of five seconds. The solution heat treatment temperature was 800° C. for the materials containing 2.5% by weight of titanium, 850° C. for those containing 4.0% and 870° C. for those containing 5.5%. The materials in which a structure having a fine, uniformly precipitated secondary phase had been formed by the annealing treatment, obtained a uniform solution heat-treated structure having an average crystal grain size not exceeding 20 microns. The materials in which a fine, but slightly less uniform secondary phase had been precipitated in a large quantity as a result of the annealing treatment, obtained a structure having an average crystal grain size essentially not exceeding 25 microns. All of the other materials, however, obtained a solution heat-treated structure having an average crystal grain size of 30 microns or more.

The annealed materials were cold-rolled to a thickness of 0.3 mm. The cold-rolled products were solution heat-treated at the temperatures hereinabove set forth for three seconds, and water-cooled. Exactly the same results as hereinabove described were obtained.

What is claimed is:

1. A process for producing an age-hardened copper titanium alloy strip, comprising:

preparing a copper titanium alloy melt;

casting said melt;

hot-working the cast alloy;

annealing the worked alloy at a temperature which is lower than a solid solution boundary temperature and lower than a recrystallization temperature; and subjecting the annealed alloy to solution heat treatment, said solution heat treatment being terminated by water-cooling before or approximately as soon as a precipitated secondary phase has dissolved in a master phase and forms a solid solution with the master phase.

2. The process as set forth in claim 1, wherein said annealing is effected at a temperature of 500° C. to 700° C. for a period of one to 20 hours.

3. The process as set forth in claim 1, wherein said solution heat treatment is effected under conditions which result in said master phase having a maximum average crystal grain size of 25 microns.

4. The process as set forth in claim 3, wherein said solution heat treatment is terminated within three minutes.

5. The process as set forth in claim 1, wherein said alloy contains 2 to 6% by weight of titanium, the balance being essentially copper.

6. The process as set forth in claim 5, wherein said alloy contains 3 to 5% by weight of titanium.

7. The process as set forth in claim 3, wherein said maximum average crystal grain size is 15 microns.

8. The process as set forth in claim 3, wherein said solution heat treatment is effected at a temperature of 800° C. to 870° C.

9. The process as set forth in claim 1, wherein said annealed alloy is cold-worked prior to said solution heat treatment.

10. The process as set forth in claim 1, wherein said alloy further comprises at least one element selected from the group consisting of iron, zirconium, chromium, boron and silicon, the balance being essentially copper.

11. The process as set forth in claim 1, wherein said hot-worked alloy is heat-treated and cold-rolled prior to said annealing.

12. A process for producing an age-hardened copper titanium alloy strip, comprising:

preparing a copper titanium alloy melt;

casting said melt;

hot-working the cast alloy;

annealing the worked alloy at a temperature of 500° C. to 700° C. for a period of time of 1 to 20 hours, said annealing occurring at a temperature which is lower than a solid solution boundary temperature and lower than a recrystallization temperature; and subjecting the annealed alloy to a solution heat treatment at a temperature of 800° C. to 870° C., said solution heat treatment being terminated by water-cooling before or approximately as soon as a precipitated secondary phase has dissolved in a master phase and forms a solid solution with the master phase, thereby resulting in an average crystal grain size of not greater than 25 microns.

* * * * *